US006315430B1

(12) United States Patent
Huang

(10) Patent No.: US 6,315,430 B1
(45) Date of Patent: Nov. 13, 2001

(54) MINIATURE LAMP HAVING MULTIPLE WIRE HOLDERS

(76) Inventor: Shun-Feng Huang, No. 56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/507,307

(22) Filed: Feb. 18, 2000

(51) Int. Cl.[7] ..... F21V 21/00
(52) U.S. Cl. ..... 362/249; 362/227; 362/252
(58) Field of Search ..... 362/226, 227, 362/249, 252, 253, 443, 806; 439/611, 616, 476.1, 483, 571

(56) References Cited

U.S. PATENT DOCUMENTS 5,645,342 * 7/1997 Chang ..... 362/252
5,669,707 * 9/1997 Huang ..... 362/249
5,697,698 * 12/1997 Huang ..... 362/226
5,775,802 * 7/1998 Kuo ..... 362/396
5,779,352 * 7/1998 Lin ..... 362/249
5,791,765 * 8/1998 Lin ..... 362/249
5,800,046 * 9/1998 Lin ..... 362/252
5,908,238 * 6/1999 Huang ..... 362/391
6,190,021 * 2/2001 Huang ..... 362/227

* cited by examiner

*Primary Examiner*—Sandra O'Shea
*Assistant Examiner*—Ismael Negron

(57) ABSTRACT

A Christmas light includes a socket having an upper opening, a pair of electrical wires extending outward from the bottom each including an upper end connected to a contact plate inside the socket, a vertical clamp on an outer periphery of the socket and a transverse slot in a top of the clamp, a base inserted into the upper opening of the socket having a lamp in the top, a pair of lead-in wires on the bottom engaged to the contact plates and an arcuate extension on an upper outer periphery including a straight vertical portion made engageable into a slit opening of the clamp. A transverse wire can be engaged within the transverse slot and a vertical wire can be engaged within the clamp so as to reticulate a neat right angled network of a light pattern without twisting the wires.

4 Claims, 14 Drawing Sheets

MINIATURE LAMP HAVING MULTIPLE WIRE HOLDERS

BACKGROUND OF THE INVENTION

The present invention relates to the Christmas lights and more particularly to a miniature lamp having multiple wire holders which has a vertical clamp and a transverse slot for facilitating the user to reticulate a right angled network of lights without twisting the wires.

Typical Christmas lights capable of reticulating a light network (as shown in FIG. 1) comprises a socket 1 and a hook 2 projected outward from an outer periphery of the socket 1. The hook 1 holds the electrical wires 3 which either come from the Christmas light itself or from an adjacent Christmas light so as to be able to reticulate a network of light patterns for decoration purpose. However, this single hook 2 could not keep the wires neat or straight but twisted in a great mess. Other type of Christmas light can straightly hold a wire but it could not hold a vertical wire and a transverse wire simultaneously.

SUMMARY OF THE PRESENT INVENTION

The present invention has a main object to provide a miniature lamp having multiple wire holders which has a vertical clamp and a transverse slot on an outer periphery capable of straightly and neatly to hold a vertical wire and a transverse wire simultaneously.

Another object of the present invention is to provide a miniature lamp having multiple wire holders which facilitates the user to reticulate a right angled network of light patterns without twisting the wires.

The present invention will become more fully understood by reference to the following detailed description thereof when read in conjunction with the attached drawings.

DETAILED DESCRIPTION OF THE PREFERRED EMBODIMENT

Figure 1:
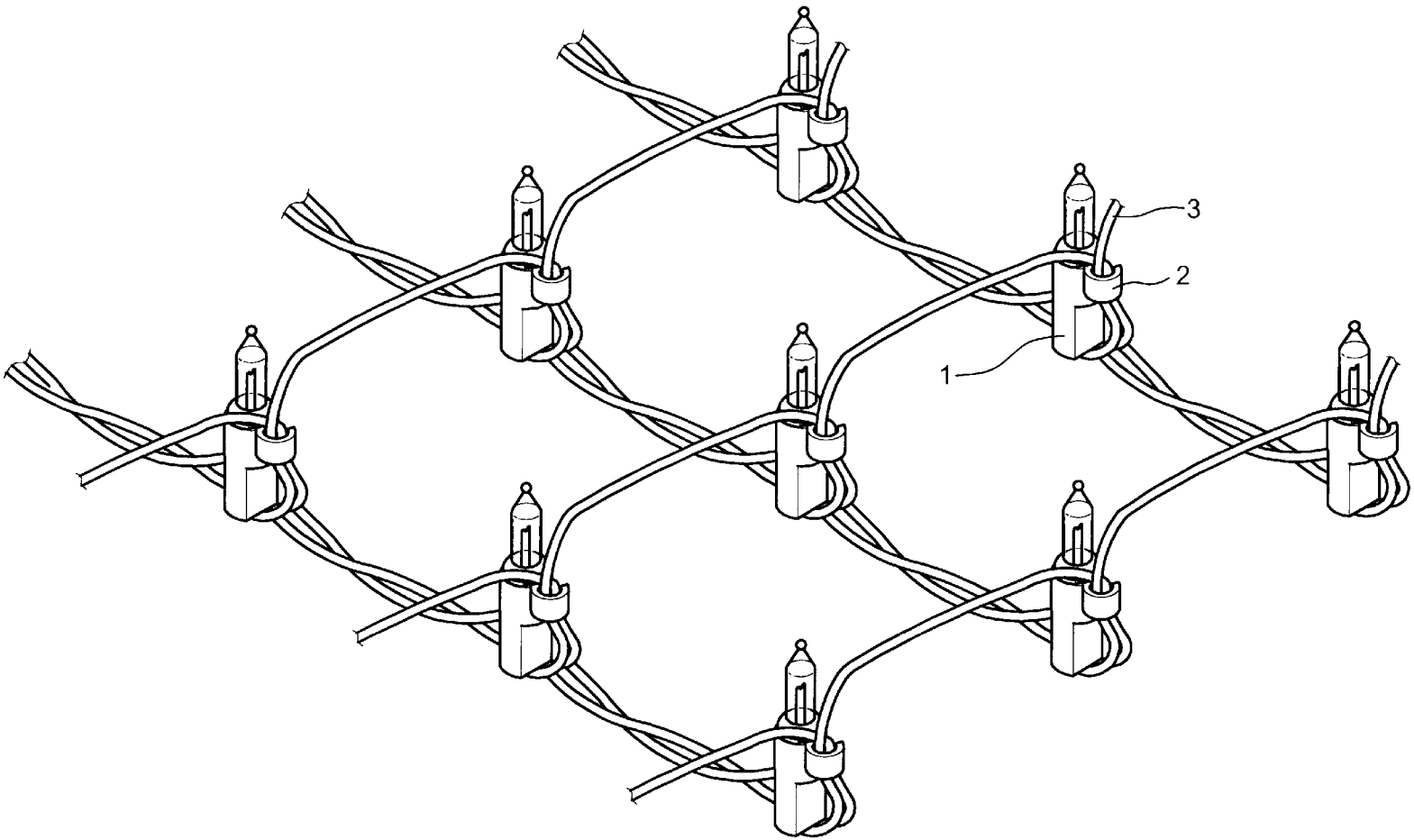
FIG. 1 Prior Art
FIG. 1 is a perspective view to show a network of light pattern reticulated by the Christmas lights of a prior art.
Figure 2:
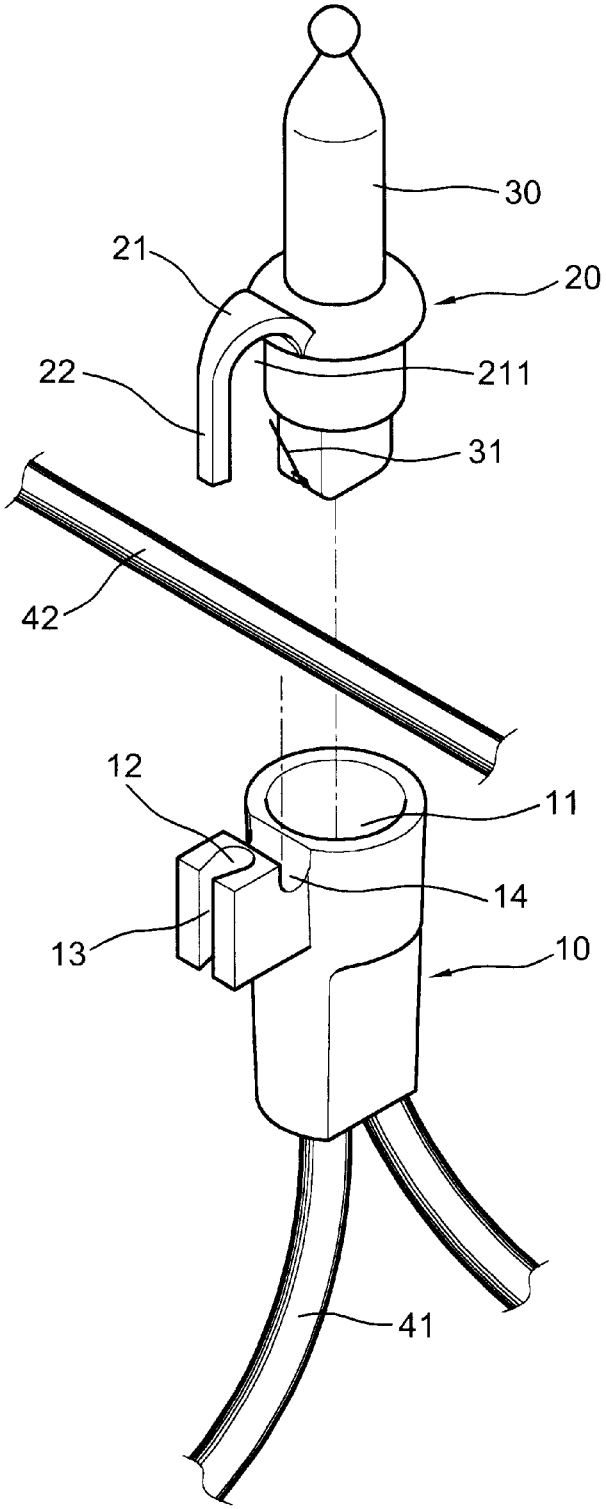
FIG. 2 is an exploded perspective view to show a Christmas light of a first preferred embodiment of the present invention.
Figure 3:
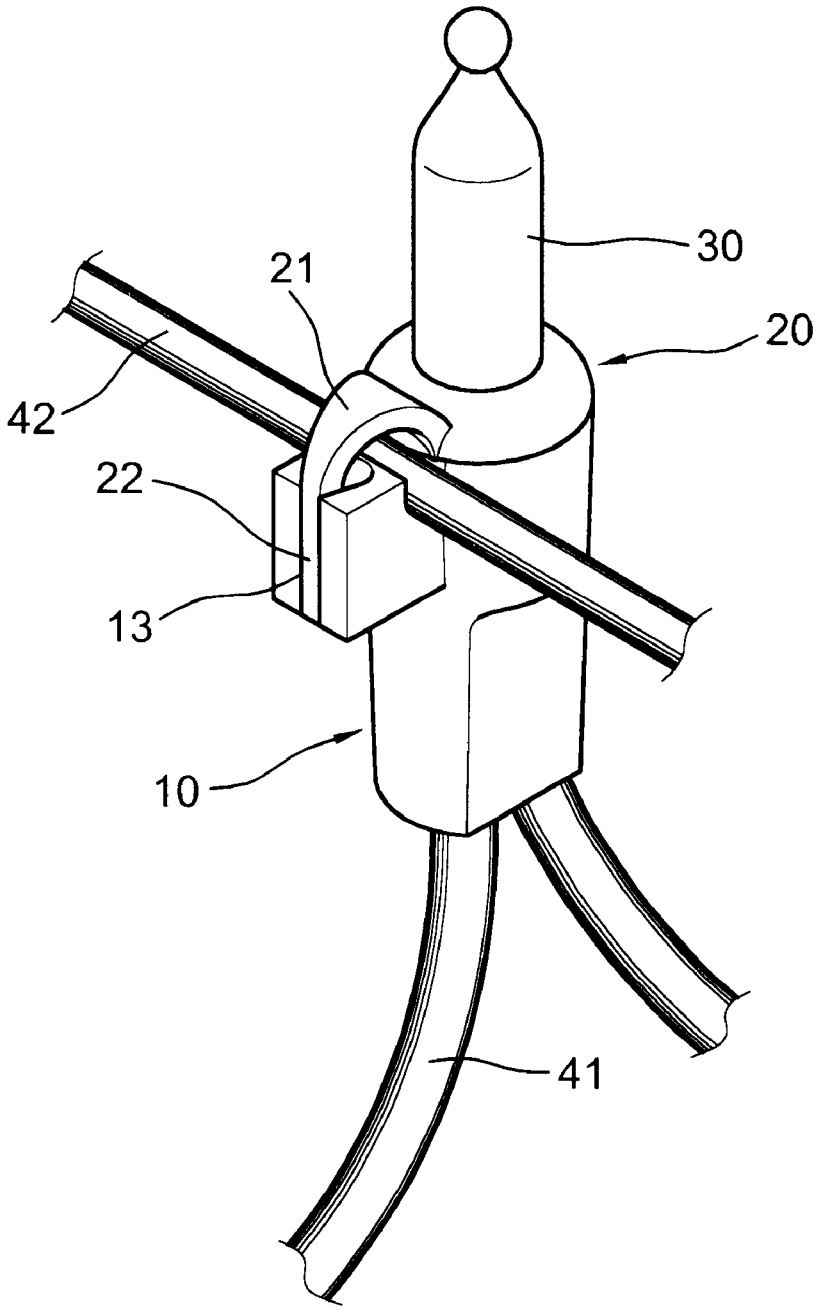
FIG. 3 is a perspective view to show an assemblage of the Christmas light of FIG. 2.

With reference to FIGS. 2 and 3 of the drawings, a first preferred embodiment of the Christmas light according to the present invention comprises generally a socket 10 including a pair of electrical wires 41 extending outward each having an upper end connected to a contact plate inside the socket 10, a base 20 inserted into the opening 11 of the socket 10 including a lamp 30 in the top, a pair of lead-in wire 31 on the bottom engageable with the contact plates respectively and an arcuate extension 21 extending outward from an upper periphery having a straight portion 22 toward downward.

The socket further includes a vertical clamp 12 projected outward from an upper periphery having a slit opening 13 and a transverse slot 14 formed in the top of the clamp 12 and between the outer periphery of the socket 10 and the clamp 12. FIG. 3 shows an assemblage of the Christmas light according to the first preferred embodiment of the present invention, where a transverse wire 42 is engaged into the transverse slot 14 and held by the arcuate extension 21 which the straight portion 22 is snap fitted into the opening 13 of the clamp 12.

Figure 4:
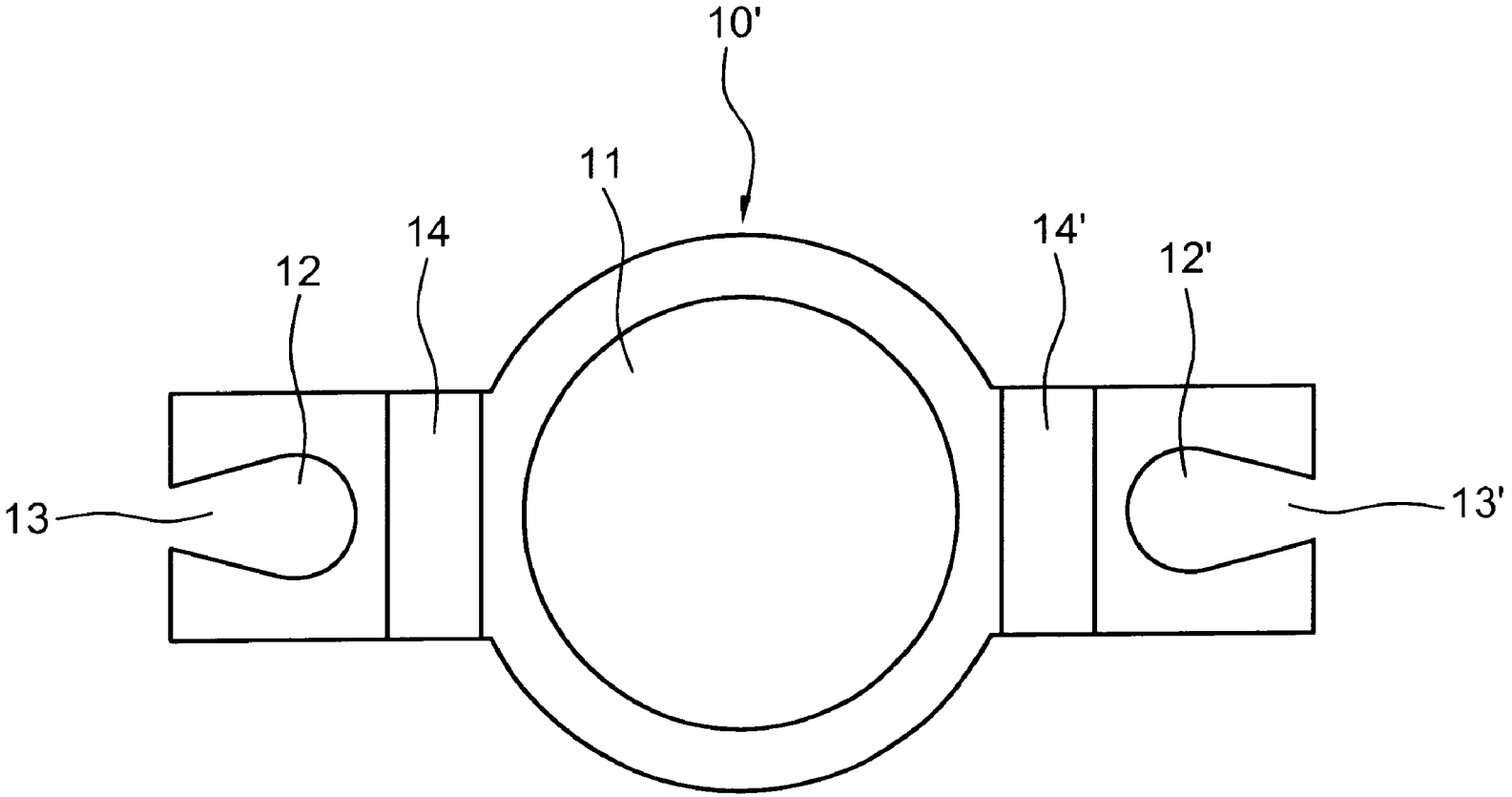
FIG. 4 is a top view to show a socket that includes two clamps and two slots.

FIG. 4 shows an alternative structure of the socket 10' of the first embodiment which contains an additional vertical clamp 12' and an additional slot 14' on the other periphery of the socket 10' opposite to the clamp 12 and the slot 14. The clamp 12' has also an opening 13'. Such alternative structure of the socket 10' is capable of holding the additional vertical or transverse wires.

Figure 5:
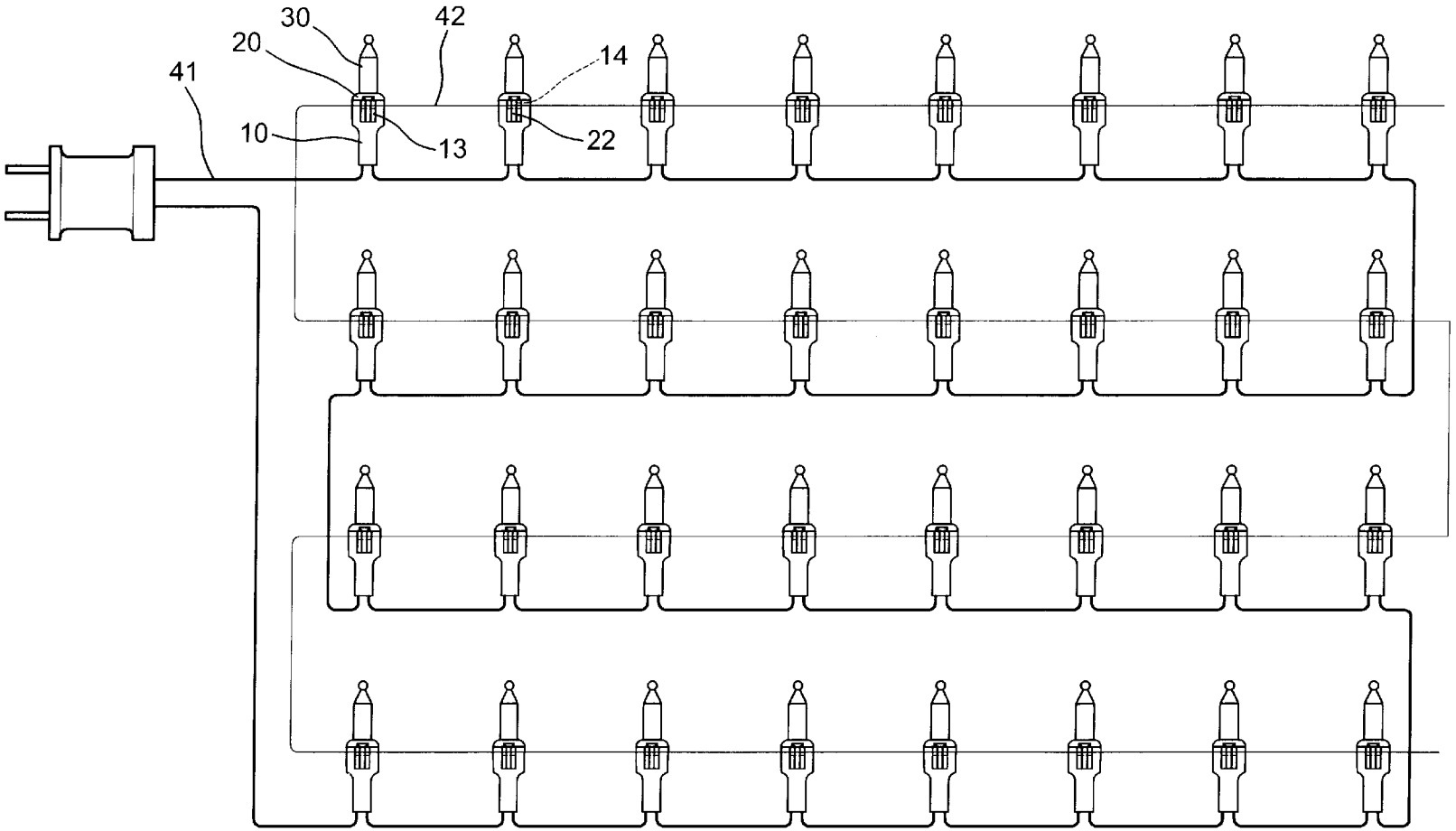
FIG. 5 is a plane view to show a network reticulated by the Christmas lights of FIG. 3.

FIG. 5 shows a network of light pattern reticulated with the Christmas light of the first preferred embodiment according to the present invention in which a transverse wire 42 is regularly engaged in the transverse slots 14 and held by the straight portions 22 of the arcuate extensions 21 of a plurality of Christmas lights.

Figure 6:
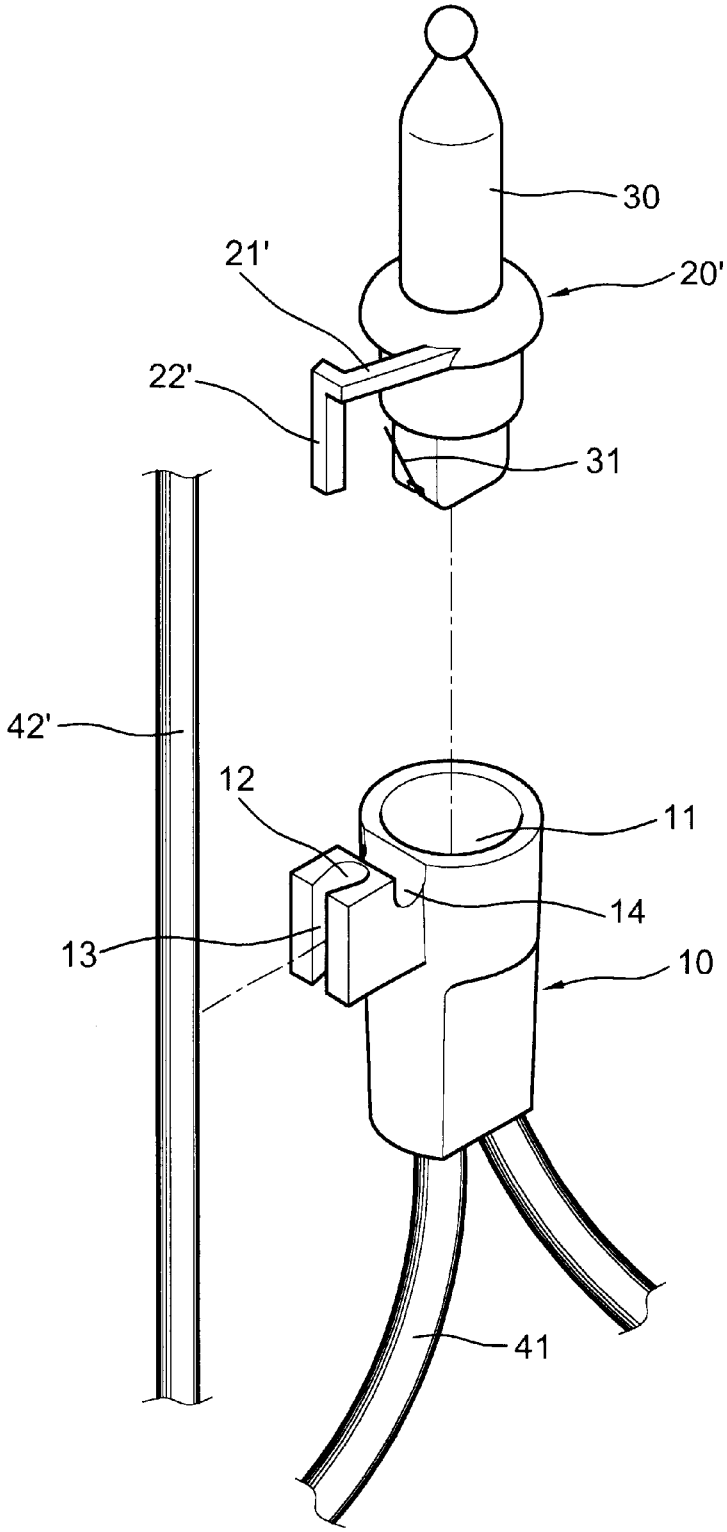
FIG. 6 is an exploded perspective view to show a second preferred embodiment of the Christmas light according to the present invention.
Figure 7:
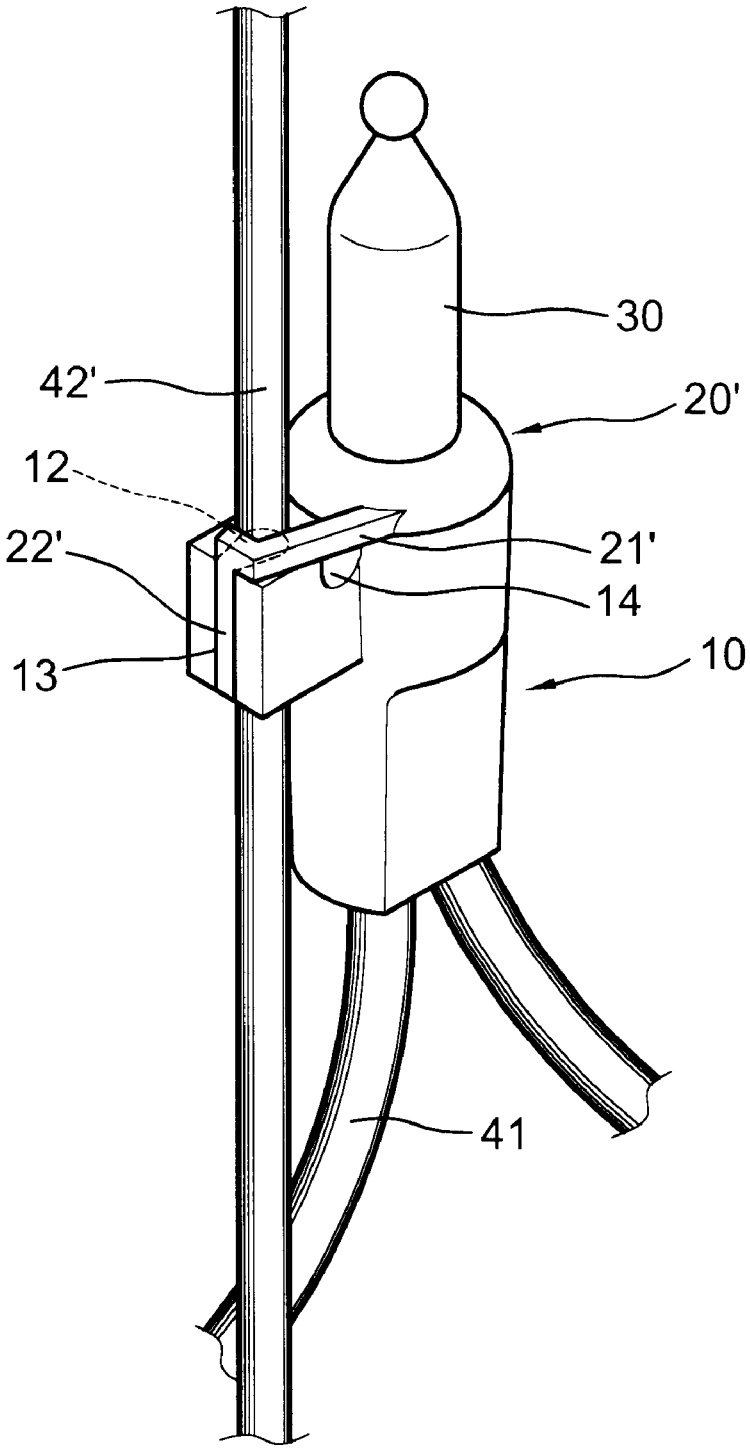
FIG. 7 is a perspective view to show an assemblage of the Christmas light of FIG. 6.
Figure 8:
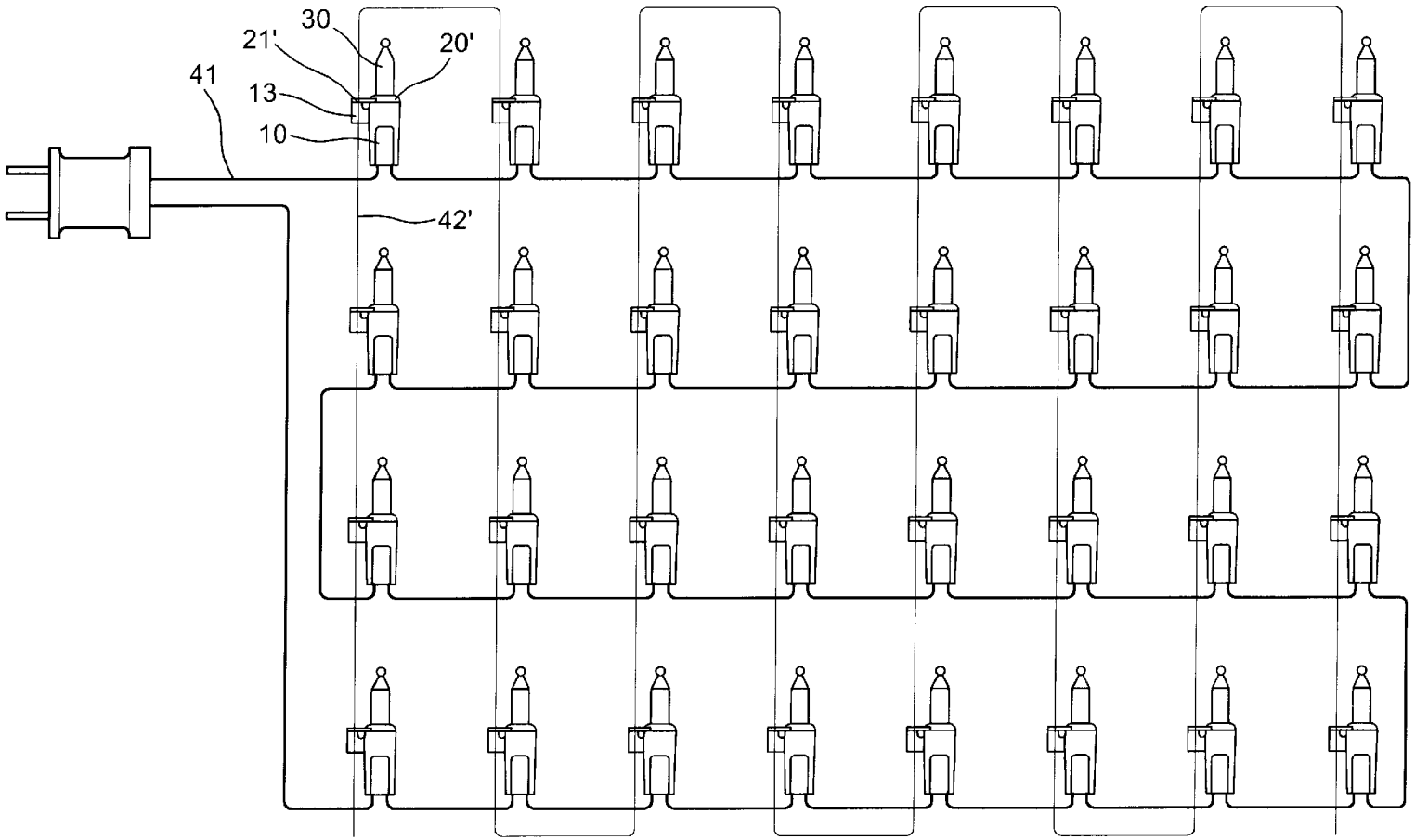
FIG. 8 is a plane view to show a network reticulated by Christmas lights of FIG. 7, FIGS. 9 and 10 are the perspective views to show that a vertical wire and a transverse wire are simultaneously held by the Christmas light of FIG. 7.

Referring to FIGS. 6 and 7, a second preferred embodiment of the Christmas light according to the present invention is provided. This embodiment is mostly similar to the first embodiment described in FIGS. 2–3 and the above descriptions are applicable in the most instances. The only change is that an alternate L-shaped extension 21' is provided instead of the arcuate extension 21 projected from an upper periphery of the base 20' and includes a transverse portion formed on the top of the vertical straight portion 22'. FIG. 7 shows an assemblage of the Christmas light of this embodiment where an vertical wire 42' is engaged into the clamp 12 and held by the alternate L-shaped extension 21'. FIG. 8 shows a network of light pattern reticulated by a plurality of the Christmas light of the second embodiment according to the present invention.

Figure 9:
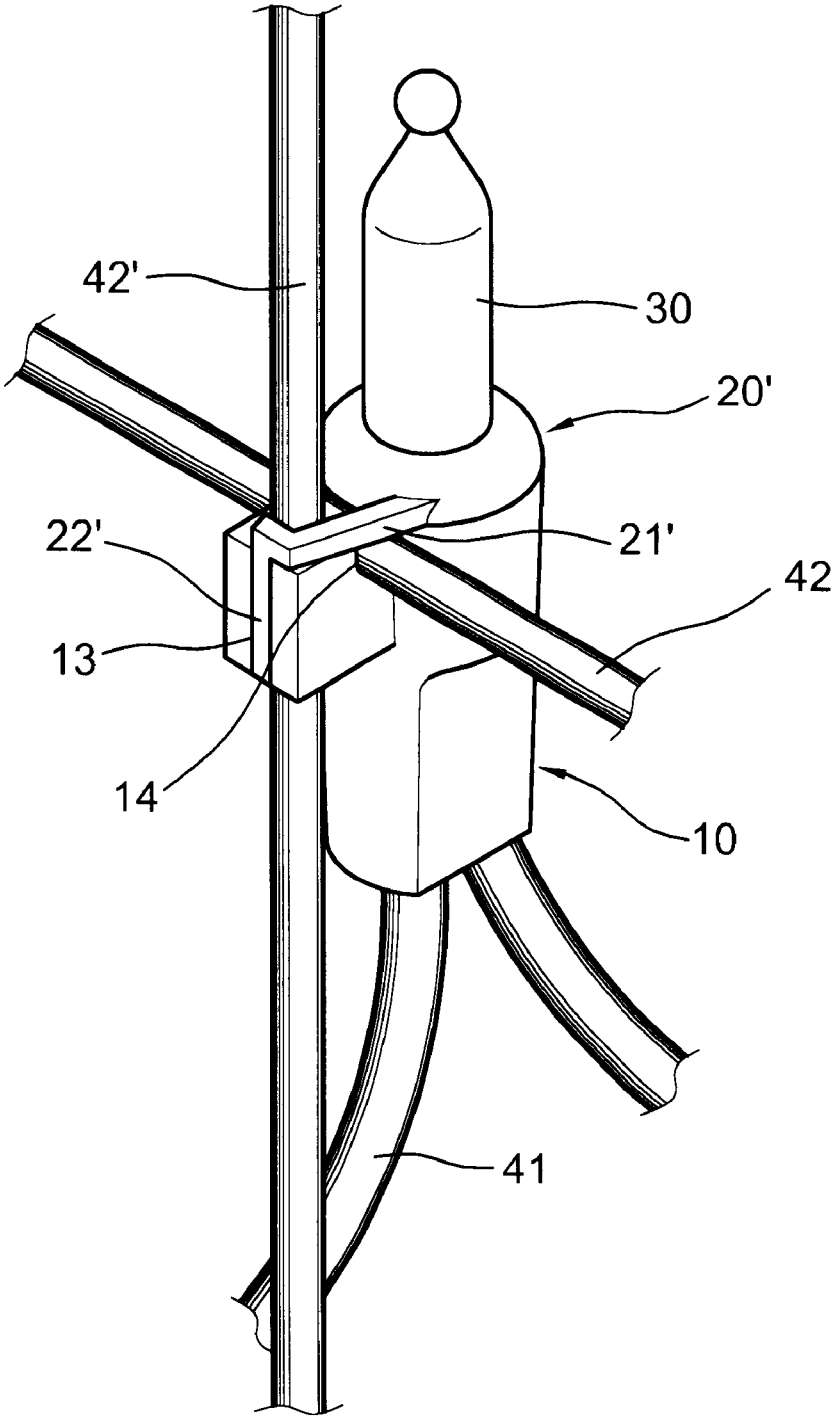
Figure 10:
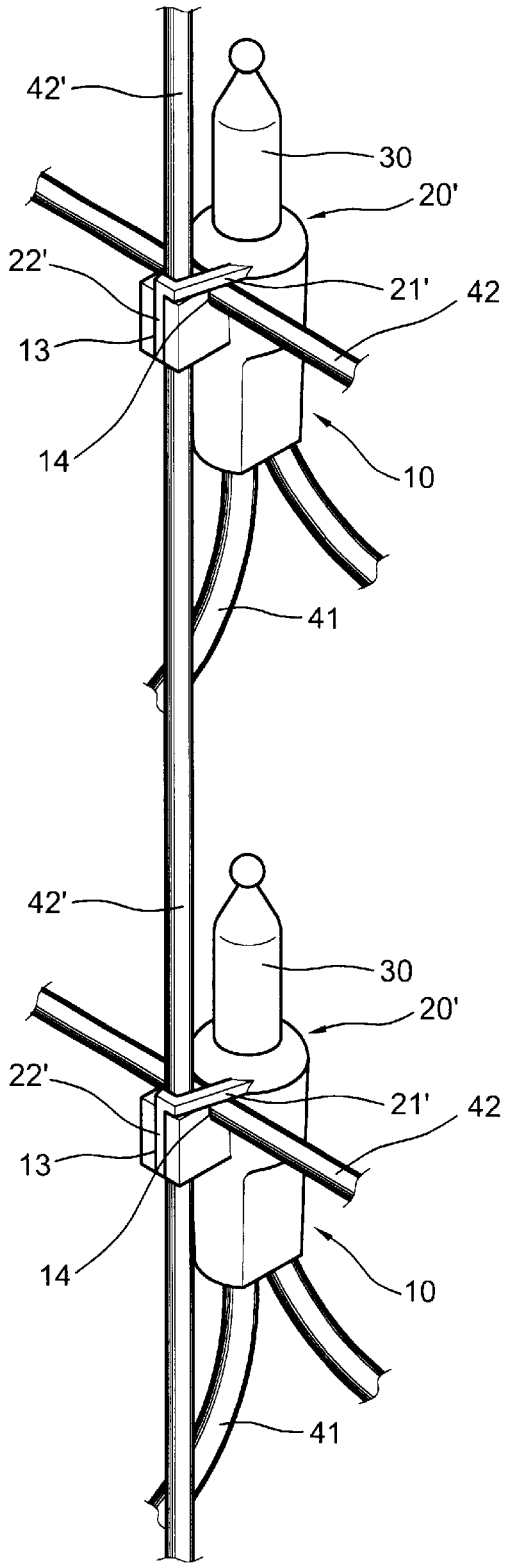
Figure 11:
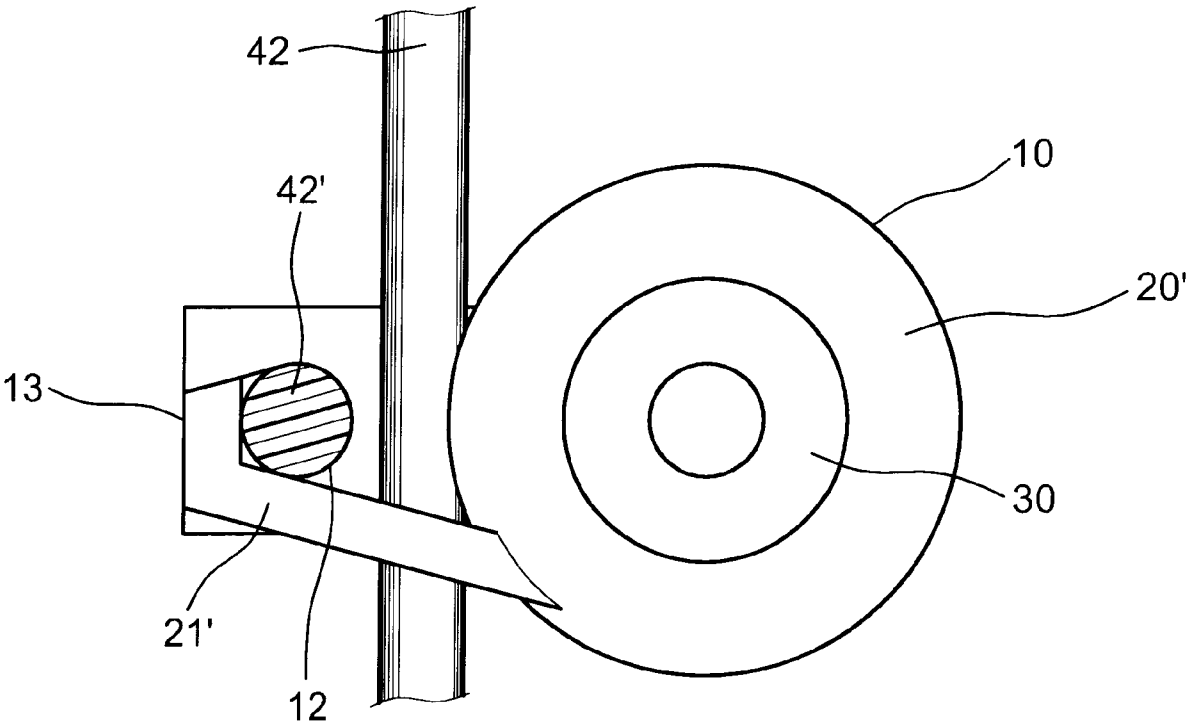
FIG. 11 is a top view of FIG. 9.

FIGS. 9, 10 and 11 show that an transverse wire 42 and an vertical wire 42' are respectively engaged in the transverse slot 14 and the vertical clamp 12 and both of them are held by the alternate L-shaped extension 21'. This improved structure of the Christmas light assures that both the transverse and vertical wires 42 and 42' will not be twisted in a right angled network of light pattern.

Figure 12:
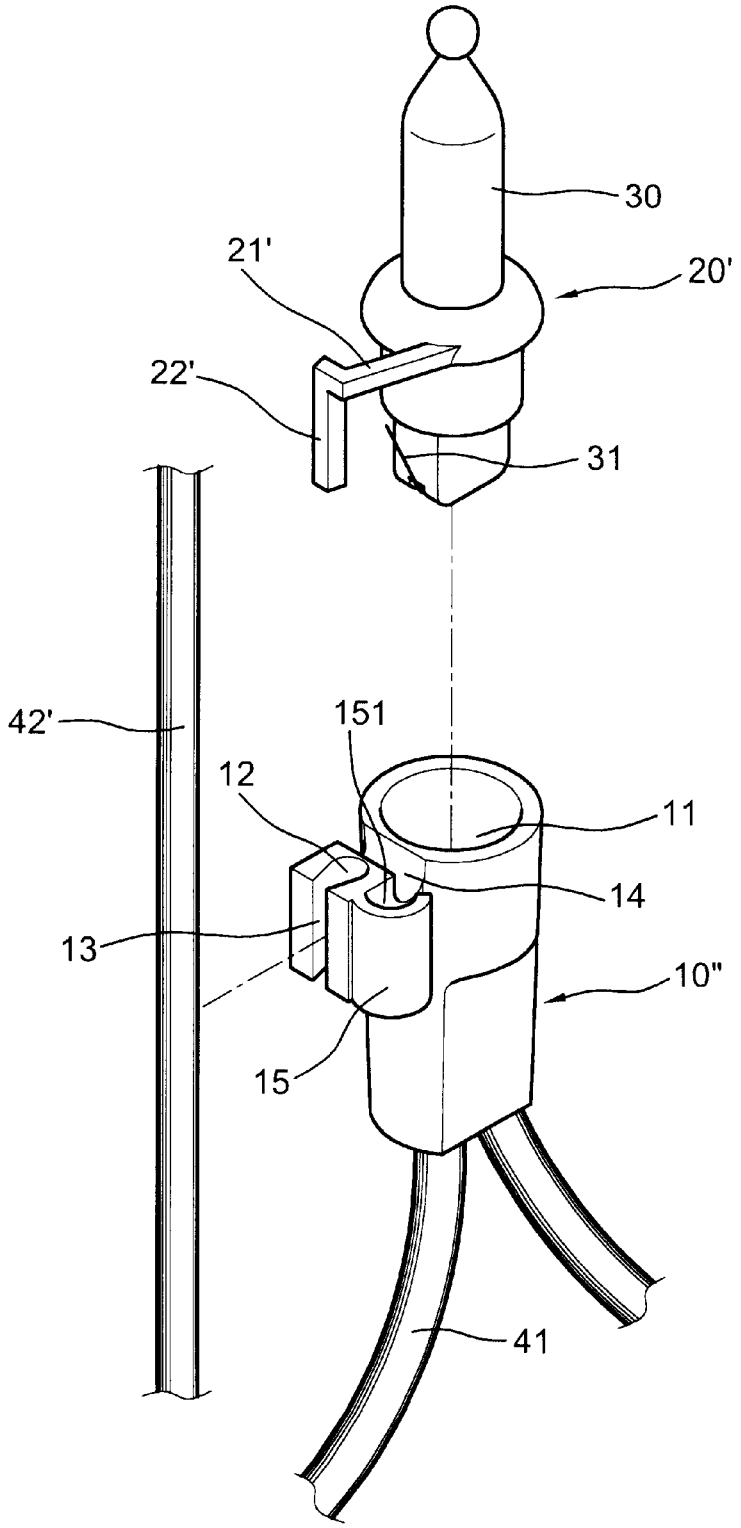
FIG. 12 is an exploded perspective view to show a third embodiment of the Christmas light according to the present invention.
Figure 13:
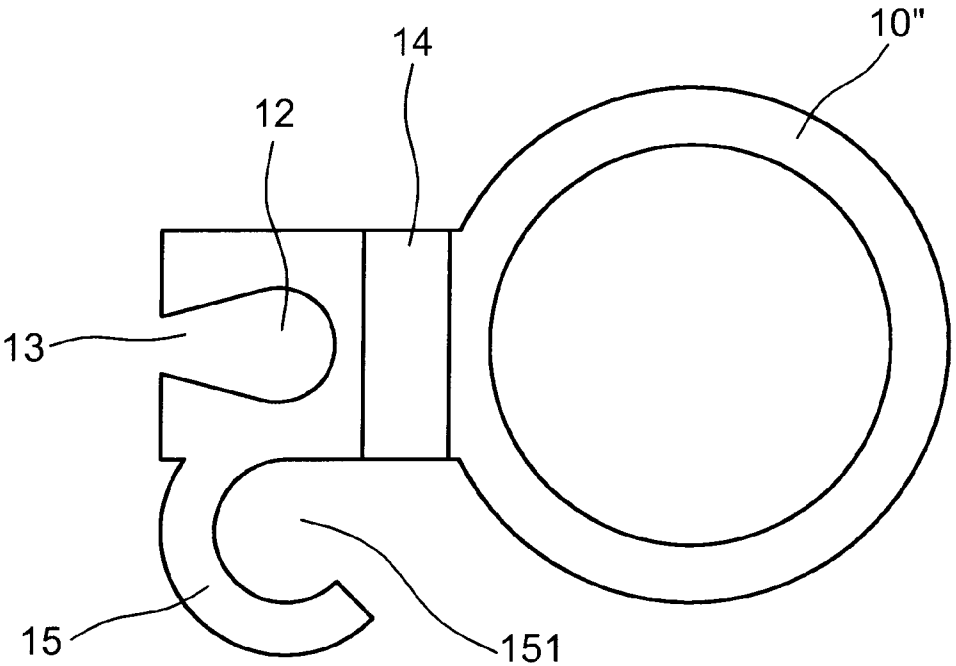
FIG. 13 is a top plane view of the socket of the third embodiment of the present invention.
Figure 14:
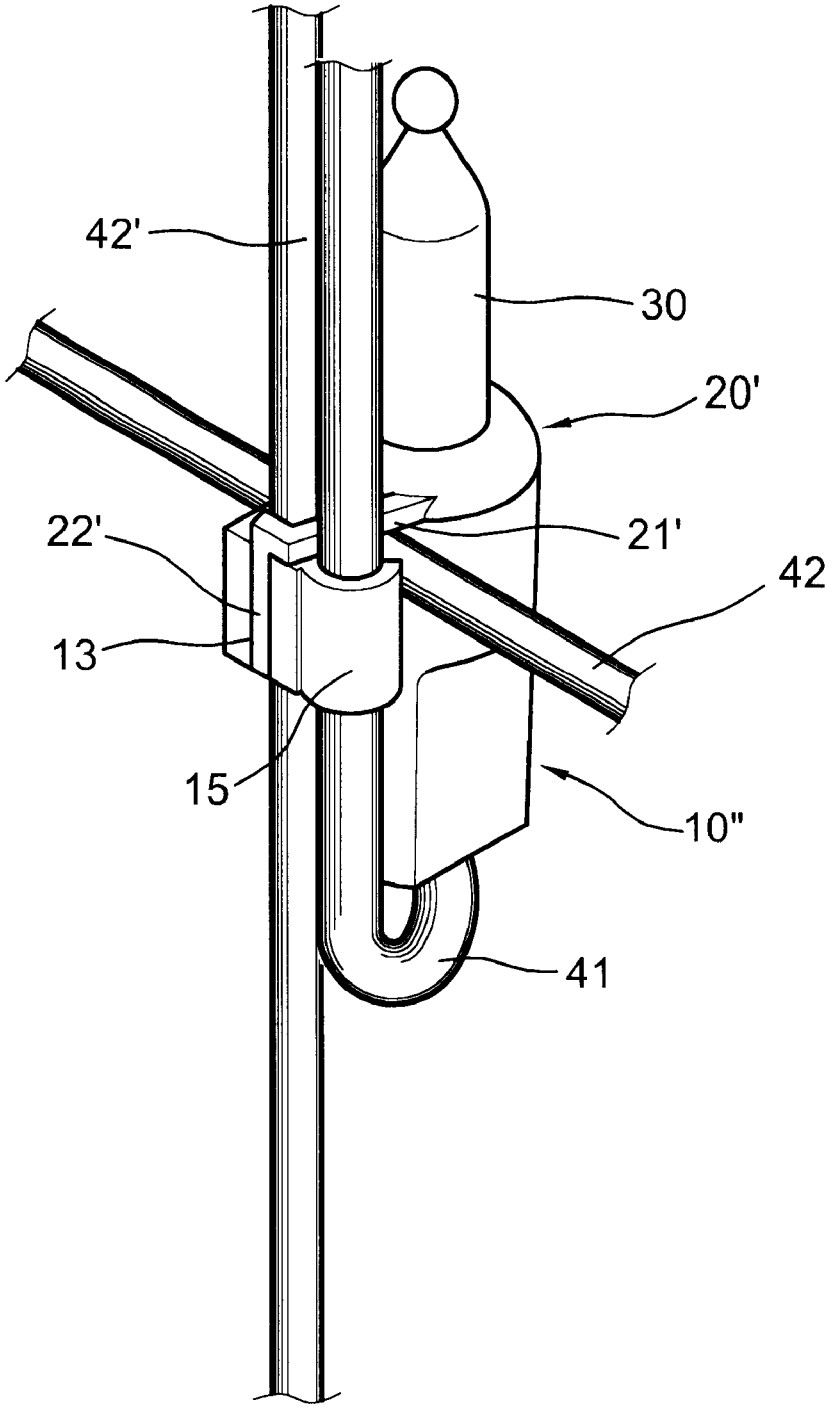
FIG. 14 is a perspective view to show an assemblage of the Christmas light of FIG. 12.

Referring to FIGS. 12 and 13, a third preferred embodiment of the Christmas light according to the present invention is provided. This embodiment is structurally and functionally most similar to second embodiment described in FIGS. 6–11. The above description are applicable in the most instances. The only change is that a hook 15 is juxtaposed with the vertical clamp 12 of the socket 10" and projected outward from a lateral side of the clamp 12. The hook defines a receiving space 151 abutting the clamp 12. Upon this improvement, one of the electrical wire 41 from the socket can be held in the receiving space 151 of the hook 15 (as shown in FIG. 14). The addition of the hook 15 can facilitate the users to reticulate a more versatile network of light patterns.

The specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

I claim:

1. A Christmas light comprising:

a socket having an upper opening, a vertical clamp including a slit opening projected outward from an upper outer periphery thereof, a transverse slot formed in a top of the clamp between the outer periphery of the socket and the clamp, and a pair of electrical wires extending outward from a bottom of the socket each having an upper end connected to a contact plate inside said socket;

a base inserted into the upper opening of said socket having a lamp centrally engaged in top, a pair of lean-in wires on bottom engaged with the contact plate of said socket respectively and an arcuate extension projected from an upper outer periphery of the base, said extension including a straight vertical portion engageable into the slit opening of the vertical clamp in a snap fitting.

2. The Christmas light as recited in claim 1 wherein said socket further has an additional vertical clamp and an additional transverse slot positioned on an outer periphery thereof opposite to the original vertical clamp.

3. A Christmas light comprising:

a socket having an upper opening, a vertical clamp including a slit opening projected outward from in a top of the clamp between the outer periphery of the socket and the clamp, and a pair of electrical wires extending outward from a bottom of the socket each having an upper end connected to a contact plate inside said socket;

a base inserted into the upper opening of said socket having a lamp centrally engaged in top, a pair of lead-in wires on bottom engaged with the contact plates of said socket respectively and a L-shaped extension extending outward from an upper periphery thereof including a transverse portion and a vertical portion engageable into the slit opening of the vertical clamp in a snap fitting.

4. A Christmas light comprising:

a socket having an upper opening, a vertical clamp including a slit opening projected outward from an upper periphery thereof, a transverse slot formed in a top of the clamp between the outer periphery of the socket and the clamp, a hook member including an arcuate receiving space projected outward from a lateral side of the clamp, and a pair of electrical wires extending outward from a bottom of the socket each having an upper end connected to a contact plate inside said socket;

a base inserted into the upper opening of said socket having a lamp centrally engaged in top, a pair of lead-in wires on bottom engaged with the contact plates of said socket respectively and an a L-shaped extension extending outward from an upper periphery thereof including a transverse portion and a vertical portion engageable into the slit opening of the vertical clamp in a snap fitting.

* * * * *